US011692251B2

(12) United States Patent
Hong

(10) Patent No.: US 11,692,251 B2
(45) Date of Patent: Jul. 4, 2023

(54) PRESSURE VESSEL STEEL SHEET HAVING EXCELLENT PWHT RESISTANCE, AND MANUFACTURING METHOD THEREFOR

(71) Applicant: POSCO, Pohang-si (KR)

(72) Inventor: Soon-Taik Hong, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 234 days.

(21) Appl. No.: 16/469,573

(22) PCT Filed: Dec. 7, 2017

(86) PCT No.: PCT/KR2017/014281
§ 371 (c)(1),
(2) Date: Jun. 13, 2019

(87) PCT Pub. No.: WO2018/117495
PCT Pub. Date: Jun. 28, 2018

(65) Prior Publication Data

US 2019/0368012 A1 Dec. 5, 2019

(30) Foreign Application Priority Data

Dec. 21, 2016 (KR) ..... 10-2016-0176127

(51) Int. Cl.

| | |
|---|---|
| ***C22C 38/04*** | (2006.01) |
| ***C21D 1/28*** | (2006.01) |
| ***C21D 6/00*** | (2006.01) |
| ***C21D 8/02*** | (2006.01) |
| ***C21D 9/50*** | (2006.01) |
| ***C22C 38/02*** | (2006.01) |
| ***C22C 38/06*** | (2006.01) |
| ***C22C 38/12*** | (2006.01) |
| ***C22C 38/16*** | (2006.01) |
| ***C22C 38/18*** | (2006.01) |

(52) U.S. Cl.
CPC ..... *C22C 38/04* (2013.01); *C21D 1/28* (2013.01); *C21D 6/005* (2013.01); *C21D 6/008* (2013.01); *C21D 8/0205* (2013.01); *C21D 8/0226* (2013.01); *C21D 8/0263* (2013.01); *C21D 9/50* (2013.01); *C22C 38/02* (2013.01); *C22C 38/06* (2013.01); *C22C 38/12* (2013.01); *C22C 38/16* (2013.01); *C22C 38/18* (2013.01); *C21D 2211/002* (2013.01); *C21D 2211/005* (2013.01); *C21D 2211/009* (2013.01)

(58) Field of Classification Search
CPC ..... C22C 38/04; C22C 38/02; C22C 38/06; C22C 38/12; C22C 38/16; C22C 38/18; C21D 1/28; C21D 6/005; C21D 8/0205; C21D 6/008; C21D 8/0263; C21D 9/50; C21D 2211/009; C21D 8/0226; C21D 2211/002; C21D 2211/005
See application file for complete search history.

(56) References Cited

U.S. PATENT DOCUMENTS

| | | | | |
|---|---|---|---|---|
| 5,591,391 | A * | 1/1997 | Igarashi | C22C 38/22 420/37 |
| 6,322,642 | B1 | 11/2001 | Bocquet et al. | |
| 2008/0283158 | A1* | 11/2008 | Nagao | C22C 38/001 148/547 |
| 2009/0252641 | A1* | 10/2009 | Hoshi | C22C 38/06 420/128 |

FOREIGN PATENT DOCUMENTS

| | | | |
|---|---|---|---|
| CN | 1918308 | A | 2/2007 |
| JP | 2000-054026 | A | 2/2000 |
| JP | 2006-045672 | A | 2/2006 |
| JP | 2006-131958 | A | 5/2006 |
| JP | 2014201815 | A | 10/2014 |
| JP | 2015-113507 | A | 6/2015 |
| KR | 10-2011-0060449 | A | 6/2011 |
| KR | 10-2012-0067149 | A | 6/2012 |
| KR | 10-2012-0067150 | A | 6/2012 |
| KR | 10-2013-0076569 | A | 7/2013 |
| KR | 10-2013-0077906 | A | 7/2013 |
| KR | 10-2014-0141839 | A | 12/2014 |
| KR | 10-2015-0074952 | A | 7/2015 |

OTHER PUBLICATIONS

Chinese Office Action dated Jul. 17, 2020 issued in Chinese Patent Application No. 201780078770.X (with English Abstract).
Japanese Office Action dated Sep. 29, 2020 issued in Japanese Patent Application No. 2019-532982.
International Search Report dated Mar. 13, 2018 issued in International Patent Application No. PCT/KR2017/014281 (with English translation).

* cited by examiner

*Primary Examiner* — Robert S Jones, Jr.
*Assistant Examiner* — Jiangtian Xu
(74) *Attorney, Agent, or Firm* — Morgan, Lewis & Bockius LLP

(57) ABSTRACT

Disclosed are a pressure vessel steel sheet and a method for manufacturing the same, the steel sheet comprising: by wt %, 0.10-0.20% of C, 0.15-0.40% of Si, 1.15-1.50% of Mn, 0.45-0.60% of Mo, 0.03-0.30% of Cu, 0.025% or less of P, 0.025% or less of S and 0.005-0.06% of sol. Al; two or more selected from the group consisting of 0.03-0.30% of Cr, 0.002-0.025% of Nb and 0.002-0.025% of Zr, and the balance of Fe and inevitable impurities, wherein the structure comprises a mixture structure of ferrite, perlite and tempered bainite after post weld heat treatment (PWHT) for 60 hours at 600-660° C., and the area fraction of the tempered bainite is at least 10% (excluding 100%).

4 Claims, No Drawings

PRESSURE VESSEL STEEL SHEET HAVING EXCELLENT PWHT RESISTANCE, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2017/014281, filed on Dec. 7, 2017, which in turn claims the benefit of Korean Application No. 10-2016-0176127, filed on Dec. 21, 2016, the entire disclosures of which applications are incorporated by reference herein.

TECHNICAL FIELD

The present disclosure relates to a pressure vessel steel sheet having excellent PWHT resistance, and a manufacturing method therefor, and more particularly, a pressure vessel steel sheet having excellent PWHT resistance which may be appropriately applied as a material for a heat recovery steam generator (HRSG), and the like, and a manufacturing method therefor.

BACKGROUND ART

According to a recent trend for oilfields in poor surroundings to be actively developed, due to the era of high oil prices as well as petroleum in being in recent short supply, a thickness of steel vessels for refining and storing crude oil has been increased.

A Post Weld Heat Treatment (PWHT) is carried out to eliminate stress generated during welding for the purpose of preventing the deformation of a structure and stabilizing a shape and a size after welding when steel is welded in addition to the above-mentioned thickening of the steel. However, a steel sheet passing through the PWHT process for a lengthy period of time may have a problem in which tensile strength of the steel sheet may be deteriorated due to coarsening of the structure of the steel sheet.

That is, a lengthy PWHT process may cause a phenomenon in which strength and toughness of the steel sheet are lowered at the same time, due to softening of matrix structures and crystal grain boundaries, growth of crystal grains, coarsening of carbides, and others.

As the conventional manufacturing method, steel has been manufactured by applying a normalizing or normalizing+a tempering heat treatment pattern using a thickened steel sheet comprising 0.10 to 0.20% of C, 0.15 to 0.40% of Si, 1.15 to 1.50% of Mn, 0.45 to 0.60% of Mo, 0.03 to 0.30% of Cu, 0.025% or less of P, and 0.025% of S, by wt %. When the steel manufactured as above is used, a welding process is required and performed to manufacture a structure. To prevent the deformation of the structure and to stabilize a shape and a size of the structure after welding, a PWHT may be performed to remove stress generated during welding. However, a steel sheet passing through the PWHT process for a lengthy period of time may have a problem in which tensile strength and impact toughness of the steel sheet may be deteriorated due to coarsening of the structure of the steel sheet.

DISCLOSURE

Technical Problem

An aspect of the present disclosure is to provide a pressure vessel steel sheet having excellent PWHT resistance, and a manufacturing method therefor.

Technical Solution

According to an aspect of the present disclosure, a pressure vessel steel sheet is provided, the pressure vessel steel sheet comprising: by wt %, 0.10-0.20% of C, 0.15-0.40% of Si, 1.15-1.50% of Mn, 0.45-0.60% of Mo, 0.03-0.30% of Cu, 0.025% or less of P, 0.025% or less of S and 0.005-0.06% of sol. Al; two or more selected from the group consisting of 0.03-0.30% of Cr, 0.002-0.025% of Nb and 0.002-0.025% of Zr, and the balance of Fe and inevitable impurities, wherein the structure comprises a mixture structure of ferrite, perlite and tempered bainite after post weld heat treatment (PWHT) for a maximum of 60 hours at 600-660° C., and the area fraction of the tempered bainite is at least 10% (excluding 100%).

According to another aspect of the present disclosure, a method of manufacturing a pressure vessel steel sheet is provided, the method comprising: reheating a slab at 1000 to 1250° C., the slab comprising 0.10 to 0.20% of C, 0.15 to 0.40% of Si, 1.15 to 1.50% of Mn, 0.45 to 0.60% of Mo, 0.03 to 0.30% of Cu, 0.025% or less of P, 0.025% or less of S and 0.005 to 0.06% of sol. Al, two or more selected from the group consisting of 0.03 to 0.30% of Cr, 0.002 to 0.025% of Nb and 0.002 to 0.025% of Zr, and the balance of Fe and inevitable impurities, by wt %; obtaining a hot-rolled steel sheet by hot-rolling the reheated slab under a condition of a reduction ratio of 2.5 to 30% per pass; performing a normalizing heat treatment on the hot-rolled steel sheet at 820 to 950° C. for 1.3×t+10 to 30 minutes, where t indicates a thickness of steel in mm units; cooling the steel sheet to which the normalizing heat treatment is performed at a speed of 2 to 30° C./sec; and performing a tempering heat treatment to the cooled steel sheet at 550 to 680° C. for 1.6×t+10 to 30 minutes, where t indicates a thickness of steel in mm units.

Advantageous Effects

According to an example embodiment in the present disclosure, a pressure vessel steel sheet of the present disclosure may have excellent PWHT resistance.

Various and beneficial advantages and effects of the present disclosure are not limited to the above-described features, but may be understood more easily while specific example embodiments of the present disclosure are described.

BEST MODE FOR INVENTION

Hereinafter, a pressure vessel steel sheet having excellent PWHT resistance, an aspect of the present disclosure, will be described in detail.

Alloy components and a desirable content range of a pressure vessel steel sheet will be described in greater detail. A content of each of the components described in the below description is based on weight % unless otherwise indicated.

C: 0.10 to 0.20%

C is an element for improving strength. When a content of C is less than 0.10%, strength of a matrix may degrade.

When a content of C exceeds 0.20%, strength may excessively increase, which may degrade toughness and weldability.

More preferably, a preferable content of C may be 0.12 to 0.18%.

Si: 0.15 to 0.40%

Si is an element which may be effective in deoxidation and solid solution strengthening and may accompany an increase of an impact transition temperature. To achieve target strength, a content of Si may need to be 0.15% or higher, but when a content of Si exceeds 0.40%, weldability may degrade, and impact toughness may be deteriorated.

More preferably, a preferable content of Si may be 0.20 to 0.35%.

Mn: 1.15 to 1.50%

Mn is an alloy element which affects strength and low temperature toughness of steel. If a content of Mn is excessively low, strength and toughness may degrade. Thus, a preferable content of Mn may be 1.15% or higher, a more preferable content may be 1.21% or higher, and an even more preferable content may be 1.30% or higher. However, when a content of Mn is excessively high, weldability may degrade, and manufacturing costs of steel may increase. Thus, a preferable upper limit of a content of Mn may be 1.50%.

Mo: 0.45 to 0.60%

Mo is an element which may improve hardenability of steel, may prevent sulfide solid cracks, and may improve strength of steel by fine carbide precipitation after quenching and tempering. To obtain such an effect in the present disclosure, a preferable content of Mo may be 0.45% or higher. However, a content of Mo is excessively high, manufacturing costs of steel may increase. Thus, a preferable upper limit of a content of Mo may be 0.60%.

Cu: 0.03 to 0.30%

Cu may be an element which may be effective in increasing strength. To obtain the strength increasing effect, a content of Cu may need to be 0.03% or higher, but as Cu is an expensive element, a preferable upper limit of a content of Cu may be 0.3%.

P: 0.025% or less

P may be one of impurities which may be inevitably added to steel. P may be an element which may degrade low temperature toughness and may increase temper embrittlement sensitivity. Thus, it may be preferable to control a content of P to be low, and in the present disclosure, a content of P may be controlled to be 0.025% or less.

S: 0.025% or less

S is one of impurities which may be inevitably added to steel, and S may be an element which may degrade low temperature toughness, and may deteriorate toughness of steel by forming an MnS inclusion. Thus, it may be preferable to control a content of S to be low, and in the present disclosure, a content of S may be controlled to be 0.025% or less.

Sol.Al: 0.005 to 0.06%

Sol.Al is one of strong deoxidizers in the steelmaking process along with Si. When a content of sol.Al is less than 0.005%, a deoxidation effect is insignificant, and when a content of sol.Al exceeds 0.06%, the deoxidation effect may be saturated and manufacturing costs may increase.

Two or more selected from the group consisting of 0.03 to 0.30% of Cr, 0.002 to 0.025% of Nb and 0.002 to 0.025% of Zr Cr is an element which may increase high temperature strength. To obtain such an effect in the present disclosure, a content of Cr may be need to be 0.03% or higher, but Cr is an expensive element, a preferable upper limit of a content of Cr may be 0.30%.

Nb is an element which may be effective in preventing a matrix structure from softening by forming fine carbides or nitrides. To obtain such an effect in the present disclosure, a content of Nb may need to be 0.002% or higher, but Nb is an expensive element, a preferable upper limit of a content of Nb may be 0.025%.

Zr is also an element which may be effective in preventing a matrix structure from softening by forming fine carbides or nitrides similarly to Nb. To obtain such an effect in the present disclosure, a content of Zr may need to be 0.002% or higher, but Zr is an expensive element, a preferable upper limit of a content of Zr may be 0.025%.

A remainder is Fe, other than the above-described composition. However, in a general manufacturing process, inevitable impurities from raw materials or a surrounding environment may be inevitably added, and thus, impurities may not be excluded. A person skilled in the art may be aware of the impurities, and thus, the descriptions of the impurities may not be particularly provided in the present disclosure.

In the description below, a microstructure after a PWHT process of a pressure vessel steel sheet of the present disclosure will be described in detail.

A structure of a pressure vessel steel sheet comprises a mixture structure of ferrite, perlite and tempered bainite after post weld heat treatment (PWHT) for a maximum of 60 hours at a temperature range of 600 to 660° C., and an area fraction of the tempered bainite may be 10% or higher (excluding 100%), and may be 12% or higher (excluding 100%) preferably. In this case, the steel sheet may be advantageous in terms of PWHT resistance. Meanwhile, the higher the area fraction of the tempered bainite, the more advantageous the steel sheet may be in terms of PWHT resistance, and thus, an upper limit thereof is not particularly limited in the present disclosure.

According to an example embodiment, a MX precipitate of a size of 10 to 100 nm, where M is Cr, Nb, and Zr, and X is N and C, is present in a crystal grain of the mixture structure, and 0.005 to 0.20% of the MX precipitate may be included by a volume fraction. In this case, the steel sheep may be more advantageous in terms of PWHT resistance. Herein, the size may refer to an equivalent circular diameter of each of detected particles by observing a cross-sectional surface of the steel sheet taken in a thickness direction.

The pressure vessel steel sheet described above may be manufactured by various methods, and the manufacturing method therefor is not particularly limited. However, as a preferable example, the pressure vessel steel sheet may be manufacture by the method as below.

In the description below, a method of manufacturing a pressure vessel steel sheet having excellent PWHT resistance will be described in greater detail according to another example embodiment. In the description of the manufacturing method, a temperature of a hot-rolled steel sheet (slab) may refer to a temperature of a t/4 position (t: a thickness of a steel sheet) from a surface of the hot-rolled steel sheet (slab) in a sheet thickness direction, unless otherwise indicated. A reference position of measurement of a cooling speed during water cooling may be also obtained as above.

A slab having the above-described composition system may be reheated at a temperature range of 1000 to 1250° C. When a reheating temperature is less than 1000° C., a solid solution of solute atoms may be difficult. When the reheating temperature exceeds 1250° C., sizes of austenite crystal grains may excessively increase, such that properties of the steel sheet may be deteriorated.

The reheated slab may be hot-rolled under a condition of a reduction ratio of 2.5 to 30% per pass (for every pass), thereby obtaining a hot-rolled steel sheet. When the reduction ratio for each pass is less than 2.5%, a reduction amount may be insufficient, which may cause internal defects. When the reduction ratio for each pass exceeds 30%, the reduction ratio may exceed a reduction capability of a facility.

A normalizing heat treatment may be performed to the hot-rolled steel sheet at a temperature range of 820 to 950° C. for 1.3×t+10 to 30 minutes, where t indicates a thickness (mm) of steel. When the normalizing heat treatment temperature is less than 820° C., re-solid solution of solute atoms may be difficult such that it may be difficult to secure strength, whereas, when the temperature exceeds 950° C., growth of crystal grains may occur, which may deteriorate low temperature toughness.

The reason why there is a limitation in the maintaining time when the normalizing heat treatment is perfomed is that, when the maintaining time is less than 1.3×t+10 minutes, homogenization of the structure may not be sufficient, and when the maintaining time exceeds 1.3×t+30 minutes, productivity may be deteriorated.

The steel sheet to which the normalizing heat treatment is performed may be cooled at a speed of 2 to 30° C./sec, as a example, may be cooled in the air.

A tempering heat treatment may be performed to the cooled steel sheet at a temperature range of 550 to 680° C. for 1.6×t+10 to 30 minutes, where t indicates a thickness (mm) of steel. When the tempering heat treatment temperature is less than 550° C., it may be difficult to secure strength as it is difficult to precipitate a fine precipitate. When the temperature exceeds 680° C., growth of a fine precipitate may occur, which may deteriorate strength and low temperature toughness.

The reason why there is a limitation in the maintaining time during the tempering heat treatment is that, when the maintaining time is less than 1.6×t+10 minutes, homogenization of the structure may not be sufficient. When the maintaining time exceeds 1.6×t+30 minutes, productivity may be deteriorated.

It may be necessary to perform a PWHT process on the pressure vessel steel sheet manufactured through the heat treatment process as above to remove residual stress by a welding process added when a pressure vessel is manufactured. Generally, strength and toughness may degrade after performing the PWHT process for a long time. However, the steel sheet manufactured in the present disclosure may be able to be welded without significant degradation of strength and toughness even after the heat treatment performed for a long time at a temperature range of 600 to 660° C., a general PWHT condition. According to an example embodiment, the pressure vessel steel sheet may have 550 MPa or higher of tensile strength, and may have 100J or higher of a charpy impact energy value at −10° C. even after the PWHT process is performed for a maximum of 60 hours at a temperature range of 600 to 660° C.

In the description below, an example embodiment of the present disclosure will be described in greater detail. It should be noted that the exemplary embodiments are provided to describe the present disclosure in greater detail, and to not limit the scope of rights of the present disclosure. The scope of rights of the present disclosure may be determined on the basis of the subject matters recited in the claims and the matters reasonably inferred from the subject matters.

MODE FOR INVENTION

Embodiment

A slab having a composition as indicated in Table 1 below was reheated for 300 minutes at 1140° C., and a hot-rolling process was completed in a recrystallization area (1100 to 900° C.) under a condition of a reduction ratio of 10 to 15% per pass, thereby obtaining a hot-rolled steel sheet. Thereafter, a normalizing heat treatment was performed to the hot-rolled steel sheet for 1.3×t+20 minutes at 890° C., the steel sheet was cooled in the air, and a tempering heat treatment was performed to the cooled steel sheet for 1.6×t+20 minutes at 650° C., thereby obtaining a pressure vessel steel sheet.

A PWHT process was performed under conditions for a pressure vessel listed in Table 2 below, a microstructure was analyzed, and yield strength, tensile strength, an elongation rate, and low temperature impact toughness were measured and listed in Table 2. With respect to all examples in Table 2, residual structures other than tempered bainite were ferrite and perlite, and a precipitate volume may refer to a volume fraction of an MX precipitate of a size of 10 to 100 nm, where M is Cr, Nb, and Zr, and X is N and C, present in a crystal grain of a mixture structure of ferrite, perlite and tempered bainite. Also, YS, TS, El, and CVN @ −10° C. may refer to yield strength, tensile strength, an elongation rate, and low temperature impact toughness, respectively, and the low temperature impact toughness may be a charpy impact energy value obtained by performing a charpy impact test to samples having a V notch at −10° C.

TABLE 1

| Steel | Alloy Composition (wt %) | | | | | | | | | | |
|---|---|---|---|---|---|---|---|---|---|---|---|
| Type | C | Mn | Si | P | S | sol.Al | Mo | Cu | Cr | Nb | Zr |
| Inventive steel 1 | 0.17 | 1.43 | 0.35 | 0.008 | 0.0014 | 0.028 | 0.50 | 0.15 | 0.15 | 0.016 | — |
| Inventive steel 2 | 0.18 | 1.46 | 0.32 | 0.010 | 0.0013 | 0.031 | 0.53 | 0.13 | 0.14 | — | 0.017 |
| Inventive steel 3 | 0.17 | 1.45 | 0.35 | 0.009 | 0.0015 | 0.030 | 0.51 | 0.14 | — | 0.015 | 0.014 |
| Comparative steel 1 | 0.17 | 1.44 | 0.36 | 0.009 | 0.0013 | 0.030 | 0.50 | 0.13 | — | — | — |

TABLE 2

| | | | | Microstructure | | | Mechanical | | | |
|---|---|---|---|---|---|---|---|---|---|---|
| | | | | Tempered | | | Properties after PWHT | | | |
| Steel Type | Steel Sheet Thickness (mm) | PWHT Temperature (° C.) | PWHT Time (hr) | Bainite Fraction (area %) | Precipitate Fraction (vol %) | Residual Structure | YS (MPa) | TS (MPa) | El (%) | CVN @ −10° C. (J) |
| Inventive steel 1 | 50 | 630 | 15 | 15 | 0.11 | 85 | 458 | 602 | 30 | 212 |
| | 100 | 630 | 30 | 13 | 0.09 | 87 | 452 | 592 | 31 | 223 |
| | 150 | 630 | 60 | 12 | 0.08 | 88 | 450 | 589 | 32 | 229 |
| Inventive steel 2 | 50 | 630 | 15 | 16 | 0.12 | 84 | 457 | 605 | 32 | 219 |
| | 100 | 630 | 30 | 15 | 0.10 | 85 | 454 | 599 | 34 | 206 |
| | 150 | 630 | 50 | 14 | 0.09 | 86 | 447 | 591 | 33 | 218 |
| Inventive steel 3 | 50 | 630 | 15 | 14 | 0.10 | 86 | 456 | 599 | 32 | 218 |
| | 100 | 630 | 30 | 13 | 0.09 | 87 | 452 | 598 | 33 | 226 |
| | 150 | 630 | 50 | 12 | 0.07 | 88 | 445 | 590 | 35 | 218 |
| Comparative steel 1 | 50 | 630 | 15 | 8 | — | 92 | 401 | 531 | 30 | 95 |
| | 100 | 630 | 30 | 6 | — | 94 | 405 | 523 | 32 | 45 |
| | 150 | 630 | 50 | 5 | — | 95 | 398 | 510 | 31 | 38 |

(In Table 2, residual structures are ferrite and perlite)

As indicated in Table 2, as for inventive steels 1 to 3 which satisfied overall alloy compositions and manufacturing conditions suggested in the present disclosure, strength and toughness was not degraded even when the PWHT time reached 60 hours, whereas comparative steel 1 did not satisfy the alloy composition suggested in the present disclosure, and strength of comparative steel 1 was degraded by approximately 50 MPa, and low temperature toughness of comparative steel 1 was degraded by 100J or higher.

While exemplary embodiments have been shown and described above, the scope of the present disclosure is not limited thereto, and it will be apparent to those skilled in the art that modifications and variations could be made without departing from the scope of the present invention as defined by the appended claims.

The invention claimed is:

1. A pressure vessel steel sheet, comprising:

by wt %, 0.10 to 0.20% of C, 0.15 to 0.40% of Si, 1.15 to 1.50% of Mn, 0.45 to 0.60% of Mo, 0.03 to 0.30% of Cu, 0.025% or less of P, 0.025% or less of S and 0.005 to 0.06% of sol. Al, 0.002 to 0.025% of Zr, one or more selected from the group consisting of 0.03 to 0.30% of Cr and 0.002 to 0.025% of Nb, and the balance of Fe and inevitable impurities, wherein the structure comprises a mixture structure of ferrite, perlite and tempered bainite after a post weld heat treatment for a maximum of 60 hours at 600 to 660° C., and an area fraction of the tempered bainite is 10% or higher, excluding 100%, wherein a MX precipitate of a size of 10 to 100 nm, where M is one of Cr, Nb, and Zr, and X is one or more of N and C, is present in a crystal grain of the mixture structure, and 0.005 to 0.20% of the MX precipitate is included by a volume fraction.

2. The pressure vessel steel sheet of claim 1, wherein a tensile strength after the post weld heat treatment for a maximum of 60 hours at 600 to 660° C. is 550 MPa or higher, and a charpy impact energy value is 100 J or higher at −10° C.

reheating a slab at 1000 to 1250° C., the slab comprising 0.10 to 0.20% of C, 0.15 to 0.40% of Si, 1.15 to 1.50% of Mn, 0.45 to 0.60% of Mo, 0.03 to 0.30% of Cu, 0.025% or less of P, 0.025% or less of S and 0.005 to 0.06% of sol. Al, 0.002 to 0.025% of Zr, one or more selected from the group consisting of 0.03 to 0.30% of Cr and 0.002 to 0.025% of Nb, and the balance of Fe and inevitable impurities, by wt %;

obtaining a hot-rolled steel sheet by hot-rolling the reheated slab under a condition of a reduction ratio of 2.5 to 30% per pass;

performing a normalizing heat treatment on the hot-rolled steel sheet at 820 to 950° C. for 1.3×t+10 to 30 minutes, where t indicates a thickness of steel in mm units;

cooling the steel sheet to which the normalizing heat treatment is performed at a speed of 2 to 30° C./sec; and performing a tempering heat treatment to the cooled steel sheet at 550 to 680° C. for 1.6×t+10 to 30 minutes, where t indicates a thickness of steel in mm units.

3. The pressure vessel steel sheet of claim 1, comprising: 0.03 to 0.30% of Cr.

4. The pressure vessel steel sheet of claim 1, comprising: 0.03 to 0.30% of Cr and 0.002 to 0.025% of Nb.

* * * * *